US005850787A

United States Patent [19]

Pichler

[11] Patent Number: 5,850,787

[45] Date of Patent: Dec. 22, 1998

[54] STAMPING DEVICE

[75] Inventor: Wolfgang Pichler, Wels, Austria

[73] Assignee: Trodat-Werke Walter Just Ges. m.b.H., Linz, Austria

[21] Appl. No.: 836,796

[22] PCT Filed: Nov. 29, 1995

[86] PCT No.: PCT/AT95/00235

§ 371 Date: May 19, 1997

§ 102(e) Date: May 19, 1997

[87] PCT Pub. No.: WO96/16816

PCT Pub. Date: Jun. 6, 1996

[30] Foreign Application Priority Data

Dec. 1, 1994 [AT] Austria ..... 2229/94

[51] Int. Cl.[6] ..... B41K 1/36; B41K 1/56

[52] U.S. Cl. ..... 101/105; 101/334; 101/405

[58] Field of Search ..... 101/103, 104, 101/105, 327, 333, 334, 405

[56] References Cited

U.S. PATENT DOCUMENTS 1,834,629 12/1931 McArdle ..... 101/103

2,075,169 3/1937 Brown ..... 101/103

4,432,281 2/1984 Wall et al. ..... 101/334

*Primary Examiner*—Edgar Burr

*Assistant Examiner*—Amanda B. Sandusky

*Attorney, Agent, or Firm*—Karl Hormann

[57] ABSTRACT

A stamping device with top inking has a frame (6) that receives a stamp (3) guided in lateral parts (6') of the frame and capable of being moved by a pivoting mechanism (5,7,8) between an ink-receiving position in which the stamp is in contact with an inking pad (2) and a printing position by means of a U-shaped actuator bow (21) coupled to the stamp and capable of being moved by hand with respect to the frame against the force of a spring. The frame that contains the stamp and the reversing mechanism (4) is mounted in a substantially parallelepiped outer housing (1) made of plastic. Both lateral parts of the outer housing (1) have slots (24) for the legs (21') of the frame and cavities (15) for compression springs (16) or the legs (21') of the actuating bow that in turn is mounted in an outer frame (22) made of plastic and provided with lateral parts (22') that also extend into both compression spring-receiving cavities (15).

6 Claims, 3 Drawing Sheets

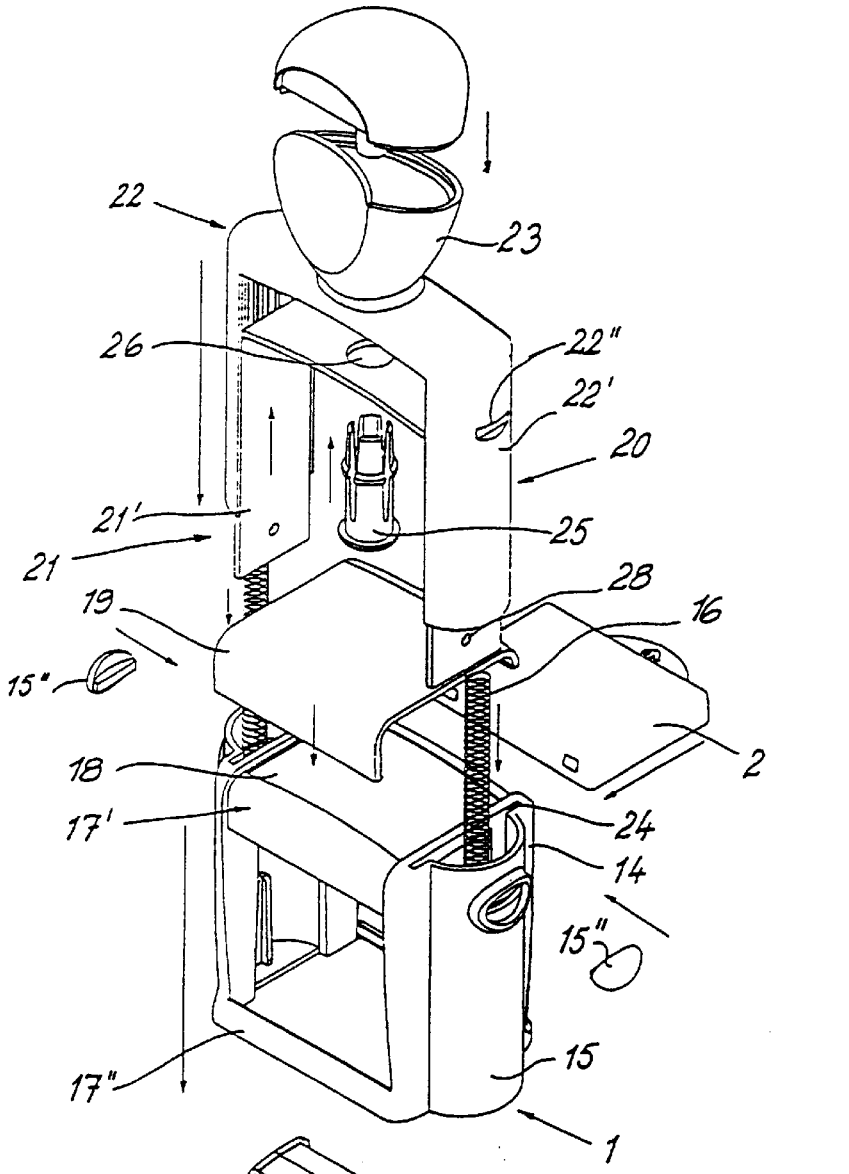
Fig.1
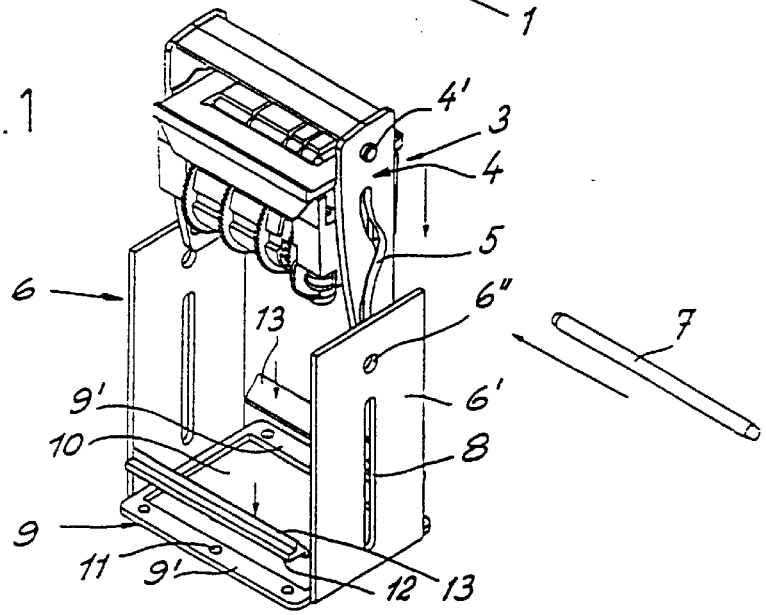

23
27
22
25
22'
22"
21'
17
19
18
2
4'
6"
15"
6"
7
5
1
16
15
3
8
6
4
15'
13
13'
6'
9

STAMPING DEVICE

CROSS REFERENCE TO RELATED APPLICATIONS

This is an application pursuant to 35 U.S.C. 371 of International Application PCT/AT95/00235 filed 29 Nov. 1995.

BACKGROUND OF THE INVENTION

1. Field of the Invention

The present invention relates to a stamping device with top inking, a preferably metallic receiving frame for a stamping insert guided in side portions of the receiving frame and reversible by means of a reversing mechanism between an ink receiving position in engagement with a ink pad and a printing position by a U-shaped preferably metallic actuator bow connected to the stamping bow and manually moveable against the bias of a spring relative to the receiving frame.

2. The Prior Art

Stamps of this type, as known, for instance, from German Offenlegungsschrift 2,020,162, are used in large numbers, and because of the requirement of longevity even under rough treatment they have hitherto been made almost entirely of metal components, with the bias spring of the actuator element being guided in a central hollow cylinder or the like extending between the upper surface of the housing and the metal bow so that the space above the upper surface of the housing cannot be used for other purposes, such as, more particularly, providing a replica of the entire image of the stamp. Moreover, the fabrication of all components from metal is exceedingly expensive and it is disadvantageous because of the scarce possibility of reusing the components making up a stamp which is no longer useable.

OBJECTS OF THE INVENTION

The invention aims at providing a stamping device of the type referred to supra which while maintaining a robust construction is, on the one hand, user-friendly relative to devices known heretofore and which, on the other hand, makes possible a more cost-efficient fabrication and reuse of the stamp. At the same time, the stamp is to ensure an improved stamped image.

SUMMARY OF THE INVENTION

The stamping device in accordance with the invention is characterized by a frame for receiving the stamping insert being mounted in a substantially parallelepiped outer housing made of plastic, in the two side portions of which there are provided receptacles for the side portions of the receiving frame and for one pressure spring each or for the arms of the actuator bow, and by the actuator bow being inserted in an external frame made of plastic the lateral portions of which extend into the two pressure spring receptacles.

In accordance with a preferred embodiment of the invention, the frame for receiving the stamping insert and the reversing mechanism forms an upwardly facing U-shaped opening, is integrally formed and is provided with a support frame portion embracing an opening through which the stamping insert may be moved.

In accordance with a further characteristic of the invention the transverse braces connecting the support frame portion are covered by rubber-like plastic staves supporting pins penetrating through openings in the transverse braces in the direction of their lower side. In this manner, slip proof placing of the stamping device and flawless centering of the printed image are ensured.

As an element of the invention, the lateral components of the external plastic housing are connected by upper and lower transverse connections and are provided with cavities for receiving the pressure springs as well as the arms of the actuator bow.

The upper transverse connection of the lateral components for practical purposes forms a coverable receptacle for receiving a replica of sample the stamp image.

In the stamping device in accordance with the invention the actuator bow of the actuator element and the U-shaped plastic frame embracing it may be connected by a pin which lockingly engages an actuator knob extending from the actuator frame.

DESCRIPTION OF THE DRAWINGS

The invention will hereinafter be described in greater detail in connection with embodiments and with reference to the drawings in which FIG. 1 is an exploded perspective view of a stamping device in accordance with the invention;

DETAILED DESCRIPTION OF THE PREFERRED EMBODIMENT

Figure 2:
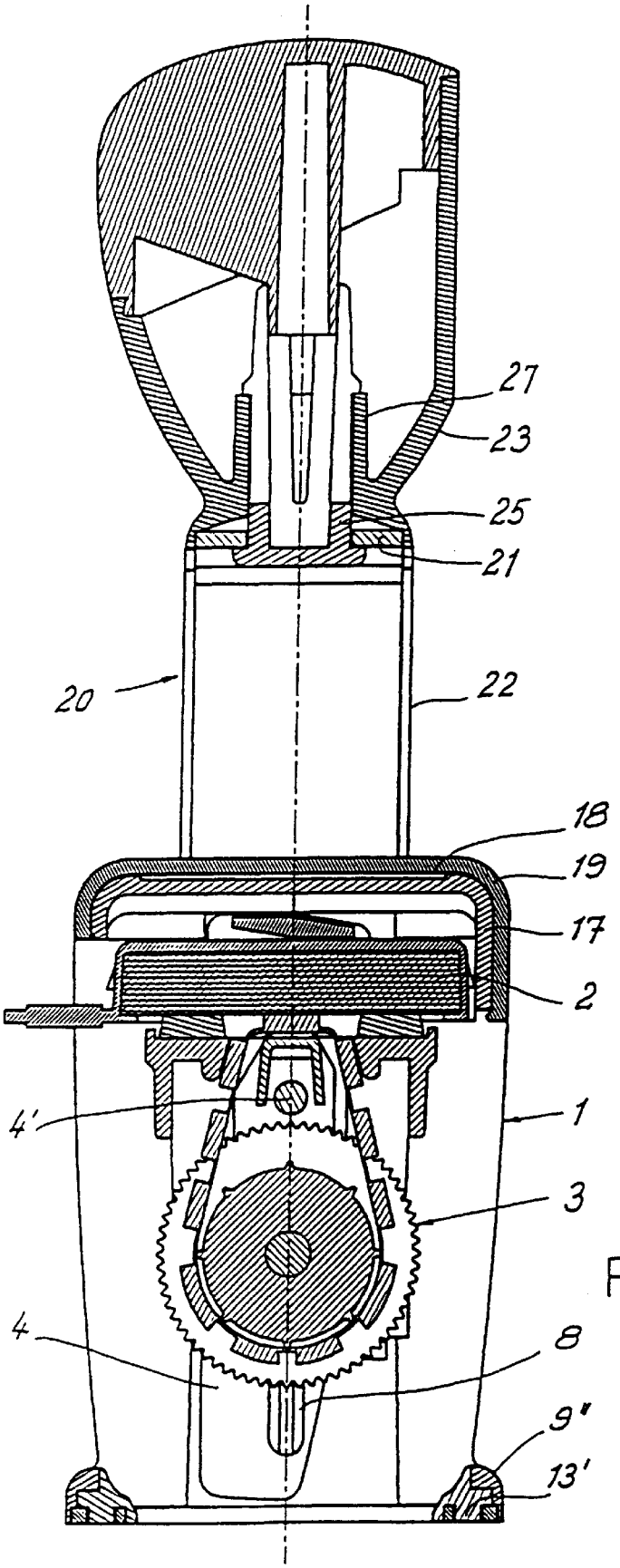
FIG. 2 is a vertical section through the assembled stamp along plane II—II of FIG. 1.

The stamp shown in the drawings is provided with a substantially parallelepiped external housing made of plastic, generally referred to by reference numeral 1, for receiving an ink pad 2 for a stamping insert 3. The date stamp insert 3 of the depicted example, together with a pivoting mechanism 4 having curved cam grooves 5, is mounted in a U-shaped metal receiving frame 6 by pins 4' extending into openings 6" of the metal frame. The metal frame 6 is open in an upward direction and may be insertable into the external housing 1. A transverse shaft 7 is extending through straight slots 8 formed in the side portions 6' of the receiving frame 6 as well as through the cam grooves 5 of the pivoting mechanism 4 of the stamping insert 3. The transverse shaft 7 is laterally inserted before the external housing 1 is mounted over the receiving frame 6.

The transverse portion of the metal frame 6 also forms a support frame member 9 connecting the side portions 6' and defining an aperture 10 through which the stamping insert 3 may be moved. Transverse braces 9' of the support frame member 9 are provided with openings 11 for pins 12 extending from plastic rails 13 made of an elastic rubber-like material, such as a thermoplastic polymer. The rails 13 are mounted on the transverse braces 9', and their function will hereinafter be explained in more detail on the basis of FIG. 2.

In its side portions 14, the external plastic hour-in 1 embracing the inner metal frame 6 is provided with outwardly bulging cavities 15 with stem-shaped spring seats 15' (FIG. 3) for receiving pressure springs 16 extending upwardly from the bottom of each cavity 15. The side portions 14 are connected to each other by upper and lower transverse connectors 17', 17". The upper transverse connector 17' of the side portions 14 of the external housing 1 extends across the ink pad 2 and forms a recessed receptacle 18 for receiving a label (not shown) with a replica of the image of the stamp, or it may serve as an engraving surface of the stamp image. It may be covered by a transparent covering bonnet 19 for protection from damage and soiling.

An actuator component 20 of the stamp is provided with an internal U-shaped metallic actuator bow 21 and a substantially U-shaped plastic external frame 22 embracing it and the center of from which a hand knob 23 also made of plastic is extending upwardly. The arms 21' of the actuator bow 21 extend into the cavities 15 of the side portions 14 of the housing where they are snapped onto the ends of the transverse shaft 7 extending from the arms 6'. Upon assembly, the side portions 6', in turn, extend into receiving slots 24 of the housing 1 associated with the cavities 15 and extending radially therefrom adjacent to the outer surface of each side portion 14. Arms 22' of the external frame 22 are also inserted into the cavities 15 of the housing 1. Also, for engaging recesses 22" in the external frame 22, snap buttons 15" may be inserted through openings in the side walls of the cavities 15, from the outside thereof.

The actuator bow 21 and the plastic frame 22 are connected to each other by means of a resiliently deformable peg 25 extending through a bore 26 in the actuator bow 21 and into a receiving bush 27 (FIG. 2) of the knob 23. The actuator bow 21 is snapped onto protrusions 7' of the transverse shaft 7 by means of a bores 28 in each arm 21'.

Figure 3:
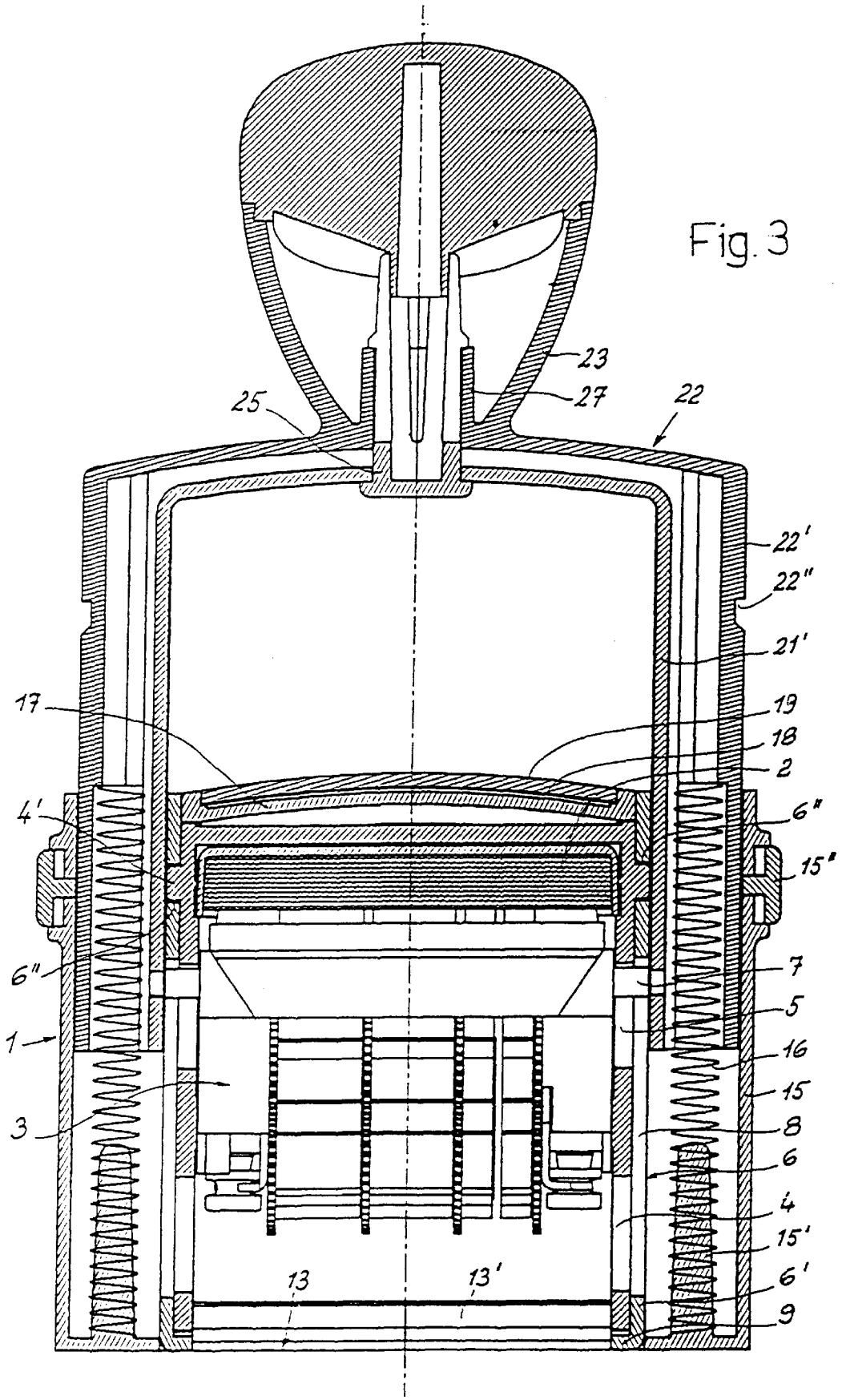
FIG. 3 is a vertical section through the assembled stamp along plane III—III of FIG. 1.

In FIGS. 2 and 3 the stamp is depicted in that position in which it receives ink from the exchangeable ink pad 2. Particularly from FIG. 2 it may be seen that the actuator knob 23 consists of two portions which may be snapped together and that it is connected to the actuator bow 21 by means of the peg 25. Further, the recessed receptacle 18 for the stamp image replica as well as the structure of the plastic cover rails 13 the inner surface 13' of which is curved so as to form a guide for the body of the stamp insert 3, are clearly visible in FIG. 2. By their lower surface, the pins 12 penetrating through the openings 11 prevent slipping of the stamping device which is of particular advantage for centering it during a stamping operation.

The stamp insert portion may be moved from its position shown in FIGS. 2 and 3 by pushing the actuator component 20 downwardly against the bias of the springs 16 thereby pivoting the insert 3 is rotating into its stamping position by means of the cam groove 5 and the shaft 7. During this movement, the insert 3 moves through the aperture 10 of the support frame 9 into intimate engagement with any surface for depositing ink thereon.

Preferably, the structure in accordance with the invention is formed with a metal stamp insert receiving frame and an actuator bow made of metal, e.g. zinc, and with an external housing or external frame made of plastic, but fabrication of the entire structure of plastic is also possible.

I claim:

1. A stamping device with top inking, comprising:

a stamping insert (3) having a reversing mechanism (4);

a receiving frame (6) made of metal and having side portions (6') for guiding the reversing mechanism (4) of the stamping insert (3);

at least one spring (16);

a plastic external frame (22) having arms (22');

a U-shaped metal actuator bow (21) having arms (21') and inserted in the plastic external frame (22) and movable relative to the receiving frame (6) against the bias of said at least one spring (16) for actuating the stamping insert (3) between an ink receiving position in engagement with an ink pad (2) and a stamping position;

a substantially parallelpiped external housing (1) of plastic having receiving slots (24) for receiving the side portions (6') of the receiving frame (6) and outwardly bulging cavities (15) for receiving at least one spring (16), the arms (21') of the U-shaped metal actuator bow (21), and the arms (22') of the plastic external frame (22).

2. The stamping device of claim 1, wherein the receiving frame (6) for guiding the reversing mechanism (4) is an integral structure of substantially U-shaped configuration and is provided between its side portions (6') with a support frame member (9) defining an aperture (10) which defined the stamping position of the stamping insert (3).

3. The stamping device of claim 2, wherein the support frame member (9) is provided with transverse braces (9') having openings (11) therein and covered by elastomeric plastic rails (13) provided with pins (12) penetrating through said openings (11) to the underside of said transverse braces (9').

4. The stamping device of claim 3, wherein at their internal side said plastic rails (13) form guide surfaces (13') for the stamping insert (3).

5. The stamping device of claim 1, wherein said external plastic housing (1) is provided with side portions (14) connected by upper and lower transverse connectors (17', 17"), said upper connector (17') forming a receptacle (18) for a stamp image adapted to be covered by a bonnet (19).

6. The stamping device of claim 1, wherein an actuator knob (23) extends from said plastic frame (22) and said actuator bow (21) is connected to said plastic frame (22) by a peg (25) which resiliently snaps into said actuator knob (23).

* * * * *